United States Patent [19]

Ohmichi

[11] Patent Number: 4,666,080

[45] Date of Patent: May 19, 1987

[54] TRAY TYPE CONTAINER

[76] Inventor: Namio Ohmichi, 5-29-12-707, Hongo, Bunkyo, Tokyo, Japan

[21] Appl. No.: 829,342

[22] Filed: Feb. 14, 1986

[30] Foreign Application Priority Data

Feb. 18, 1985 [JP] Japan ..... 60-20543[U]
Jul. 15, 1985 [JP] Japan ..... 60-106962[U]

[51] Int. Cl.[4] ..... B65D 5/20

[52] U.S. Cl. ..... 229/143; 229/152; 229/154; 229/174

[58] Field of Search ..... 229/32, 33, 34 R, DIG. 11, 229/142, 143, 152, 154, 167, 174

[56] References Cited

U.S. PATENT DOCUMENTS

| | | | |
|---|---|---|---|
| 890,222 | 6/1908 | Davidson | 229/34 R |
| 2,528,900 | 11/1952 | Meller | 229/143 |
| 2,675,161 | 4/1954 | Buttery | 229/34 R |
| 2,917,221 | 12/1959 | Risdon | 229/34 R |
| 3,207,414 | 9/1965 | Locke et al. | 229/143 |
| 3,704,823 | 12/1972 | Howe | 229/33 |

FOREIGN PATENT DOCUMENTS

| | | | |
|---|---|---|---|
| 87395 | 6/1966 | France | 229/34 R |
| 1289345 | 9/1972 | United Kingdom | 229/34 R |
| 1439600 | 6/1976 | United Kingdom | 229/33 |
| 1505963 | 4/1978 | United Kingdom | 229/33 |
| 2158809 | 11/1985 | United Kingdom | 229/34 R |

*Primary Examiner*—William Price
*Assistant Examiner*—Gary E. Elkins
*Attorney, Agent, or Firm*—Armstrong, Nikaido, Marmelstein & Kubovcik

[57] ABSTRACT

A tray type container constructed usually of a cardboard, corrugated paperboard, synthetic resin sheet or the like to transport, display and storing various products, especially a unit number of bottled, canned or cardboard packed products, for instance a bevarage, and a blank plate therefor. The container comprises essentially a generally rectangular bottom panel, two pairs of opposite upright side panels connected with the bottom panel, and a pair of upper strips, each being connected to concerned side panel to partially close an open top defined by the four side panels.

2 Claims, 4 Drawing Figures

TRAY TYPE CONTAINER

BACKGROUND OF THE INVENTION

1. Field of the Invention

The present invention relates to a tray type container usally constructed of a cardboard, corrugated paperboad or the like, as well as a blank plate therefor. The container is assembled from the blank plate to use the same for transporting, displaying and storing various products or commodities, especially a unit number of bottle, canned and carboad packed products, for instance a bevarage.

2. Related Arts

Hitherto, various tray type contaners having been proposed as disclosed, for instance in U.S. Pat. Nos. 4,353,496, 4,385,721 and 4,418,863 as well as European Pat. Pub. Nos. 109116 and 109875. Among them, each container disclosed in said U.S. patent specifications can be assembled by merely folding each panel and inserting tabs formed in the panels into concerned slits but this type container has a common disadvantage of that a reratively strong material such as corrugated paperboard, a thick cardboard or the like is required to increase its mechanical strength to allow a packing of heavier products such as a number of canned bevarage, but this causes a cost increase For packing such heavier products, therefore, another typecontainer as disclosed in the European patent publications has widely been employed.

A conventional latter type container, in general, comprises a generally rectangular bottom panel, two pairs of opposite upright side panels foldably connected with the bottom panel, and a pair of upper strip foldably connected with one of the side panel pairs to partially close an open top formed by the four side panels. In this case, each of the strips and one of the side panel pairs have a flap which should be overlapped and adhered on the concerned side panel to maintain a box-like configuration of the container. This conventional container has also disadvantages of that an adhesion of the flap connected with the upper strip to the side panel increases a cost of the container and that a mechanical strength of each corner area of the container is not so high and thus there may be a possible accident, when a number of containers accommodating heavier commodities are stacked.

SUMMARY OF THE INVENTION

It is, therefore, a principal object of the invention to provide a tray type container which shows a high mechanical strength at each corner area to allow a multistacking thereof during transportation, storing and the like.

Another object of the invention is to provide a tray type container which can be maintained in a stable box-like configuration by commodities per se which are accommodated therein.

According to the invention, these and other objects can be accomplished by a tray type container which comprises a generally rectangular bottom panel, two pairs of opposite upright side panels foldably connected with said bottom plate, and a pair of upper horizontal strip foldably connected with one of the side panel pairs, one of said side panel pair having a pair of upright flaps, each of which is foldably connected with an opposite side of the concerned side panel and is adhered to the side panel in the other side panel pair, said upper strip having a pair of corner flaps foldably connected with the concerned upper strip and the flap of said side panel, each of said corner flaps being inwardly folded along and its surface contacting with a surface of said side panel in the other side panel pair.

One of the side panel pairs, namely the opposite side panels having no flap may be of shorter than the other side panel to save a material for the container but upper sides for all of the side panels may be made in substantially same level, when more higher mechanical strength on the container or more sufficient protection of the commodities is required.

The invention also relates to a blank plate for the aforesaid tray type container. According to the invention, the blank plate comprises a generally rectangular first or central panel, a second and third panels connected with opposite sides of said first panel through folding lines, a fourth and fifth panels connected with remaining opposite sides of said first panel through folding lines and each having two flaps which are arranged in parallel to both of said second and third panels, and a sixth and seventh panels connected with a remaining side of said fourth and fifth panels through folding lines, respectively and each having two corner flaps, each of which is connected also with a concerned side of the flap for said fourth or fifth panel through a folding line and has another folding line therein.

It is preferable that the folding line formed in the corner flap of said sixth or seventh panel extends at an angle of about 45° from an intersecting point of the other folding lines to the flap of said fourth or fifth panel and to said sixth or seventh panel. A configuration of the corner flap may be of substantially a squere or an irregular quadrilateral. In case of that the corner flap has a square configuration, a free corner thereof may be cut in an optional form.

A vertical width of the second and third panels may be shorter than a horizontal width of the fouth and fifth panels to save a material for the blank plate but those may be made in substantially same value, when more higher mechanical strength on the container or more sufficient protection of the commodities is required.

PREFERRED EMBODIMENTS OF THE INVENTION

Figure 1:
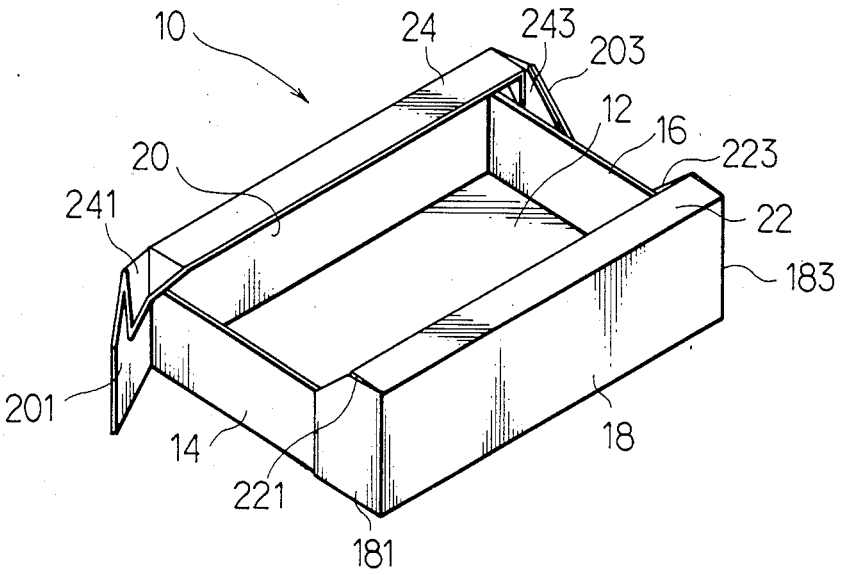
FIG. 1 is a perspective view showing a tray type container according to the first embodiment of the invention.
Figure 2:
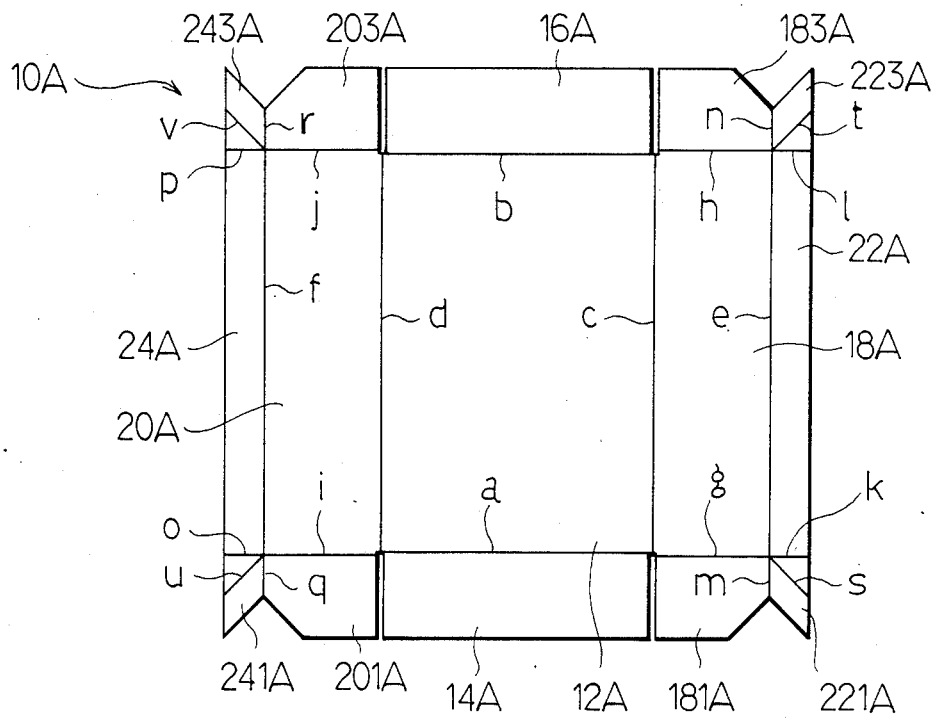
FIG. 2 is a plan view of a blank plate for the container shown in FIG. 1.

In FIGS. 1 and 2, there are shown a first embodiment of a tray type container and a blank plate therefor. The container 10 comprises a generally rectangular bottom panel 12, a pair of opposite upright side panels 14,16, each of which has a generally reactangular shape and connected with concerned side of the bottom plate 12, another pair of opposite upright side panels 18,20, each of which has a generally rectangular form and is connected also with concerned side of the bottom plate 12, and a pair of upper horizontal strips 22,24, each of which has a rectangular form and is connected with concerned side of the side panels 18,20, to partially close an open top formed by the four side panels 12,14,16 and 18 of the container 10. Each of the side panels 18, 20 has two flaps 181,183 (201,203) and each of the upper strips 22,24 has also two corner flaps 221,223 (241,243). Each of the corner flaps 221, 223,241,243 is connected with concerned side of the upper flap and the side panel. Each of the corner flaps, for instance, the corner flap 241 is inwardly folded, arranged in a position between the side panel 14 and the flap 201 of the other side panel 20, and kept in such position by adhering at least a part of an outer surface of the side panel 14 to an inner surface of the flap 201.

In this embodiment, the pair of the side panels 18,20 is taller than the other pair of the side panels 12,14 but those may be made in substantially same level.

The tray type container of this embodiment shows following advantages in comparison with a conventional container having a similar structure.

(a) When commodities, for instance, canned products are fully accommodated therein, in general, it is difficult to pick up the same and more particularly the first one, without destroying the container per se. According to the container 10 of this embodiment, a handler can easily drow out the corner flaps 221,223,241,243 by pull-up a longitudinal side or sides of the upper strip or strips 22,24 to open the container, so that he can manually deform the container for make the picking-up of the commodity easy. After taken-out one or more commodities, the strips can be manually returned in its original position to keep the containter in close state, and (b) The tray type container of this kind may oftenly be used in combination with a shrink or stretch synthetic resin film wrapping or carboard cover on top to protect the commodities therein from shoplifting and dust, and usua ly stored in a stacked state. In this case, it is difficult for a handler to take-out a commodity from or check or confirm the same in the container at an intermediate position in the stack. According to the container of this embodiment, however, the handler can easily access to the commodities by peeling-off the flaps 181,201 or 183,203 from the side panel 14 or 16 and turned the flaps and the side panel.

In FIG. 2, there is shown the blank plate for the container 10 shown in FIG. 1. In the figure, a member or element corresponding to that for the container is indicated with reference numeral same with that in FIG. 1 but with a suffix "A" in addition thereto. The blank plate 10A comprises a first or central panel 12A, a second and third panels 14A, 16A connected with opposite sides of the first panel 12A through folding lines a,b, a fourth and fifth panels 18A,20A connected with the other opposite sides of the first panel 12A through folding lines c,d, and a sixth and seventh panels 22A,24A connected with the fourth and fifth panels 18A,20A through folding lines e,f, respectively. The fourth panel 18A has two flaps 181A,183A which are connected therewith through folding lines g,h and similarly, the fifth panel 20A has two flaps 201A,203A which are connected therewith through folding lines i,j. The sixth panel 22A has two corner flaps 221A,223A which are connected therewith through folding lines k,l and with the flaps 181A,183A through folding lines m,n and similarly, the seventh panel 24A has two corner flaps 241A,243A which are connected therewith through folding lines o,p and with the flaps 201A,203A through folding lines q,r. Each of the corner flaps 221A,223A,241A,243A has an irregular quadrilateral form and has a folding line therein as indicated by s,t,u,v, each of which folding line obliquely extends, for instance the folding line t extends at an angle of about 45° from an intersecting point of the folding lines e,n and folding lines h,l.

A manner for assembling the blank plate 10A shown in FIG. 2 into the tray type container 10 shown in FIG. 1 will now be explained below.

In the first place, the second and third panels 14A and 16A are turned-up along the folding lines a,b into its upright position to form a pair of the opposite side panels 14,16. Then the sixth panel 22A is turned-up along the folding line e and each of the corner flaps 221A and 223A thereof are inwardly folded along the folding lines s and t, respectively. This causes a rise-up of the flaps 181A,183A in the fourth panel 18A and thus these flaps are inwardly folded along the folding lines g,h, respectively. Similar folding operations are carried out on the fifth panel 20A, seventh panel 24A as well as flaps thereof. Thereafter, an adhesive is applied on the flaps 181A,183A,201A,203A in the fourth and fifth panel 18A,20A at an area near the second and third panels 14A,16A and the flaps are overlapped and pressed on the second and third panels to cause an adhesion therebetween and to finally assemble into the container 10. In this case, the each of the folded corner flaps are arranged between the second (or third) panel and the flap in the concerned fourth (or fifth) panel, without application of any adhesive.

Figure 3:
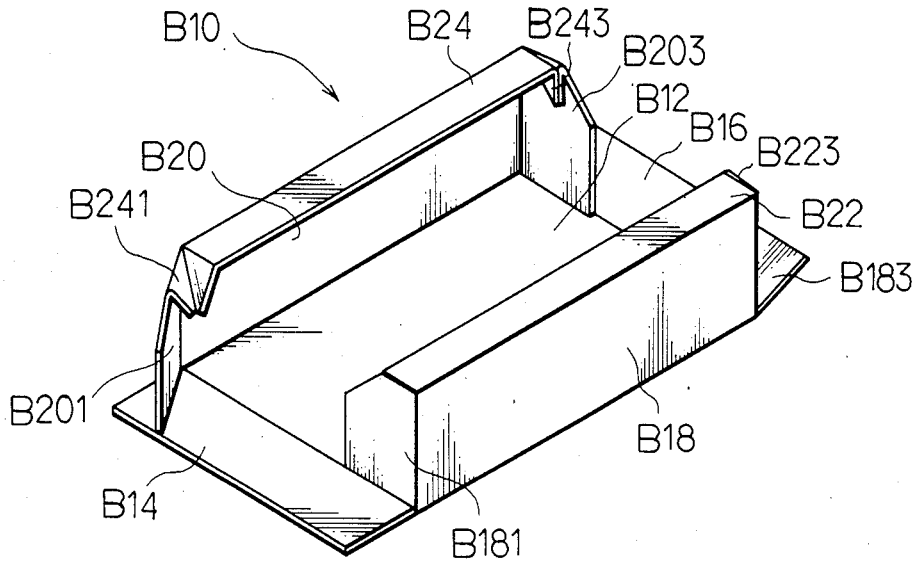
FIG. 3 is a perspective view showing another tray type container according to the second embodiment of the invention.
Figure 4:
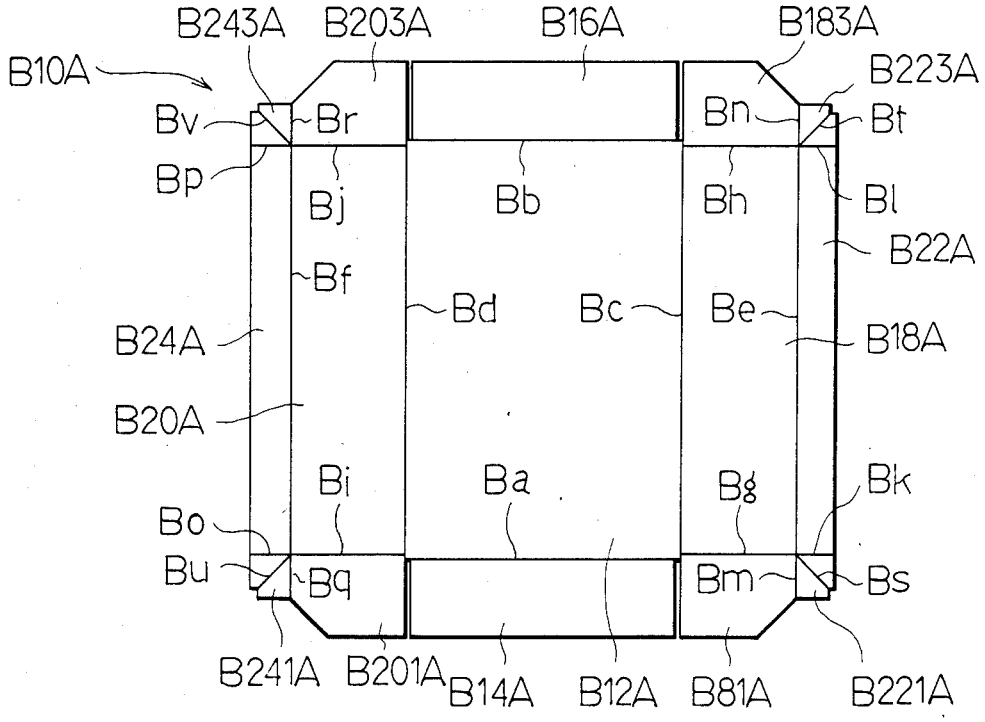
FIG. 4 is a plan view of a blank plate for the container shown in FIG. 3.

An embodiment shown in FIGS. 3 and 4 is substantially same with that shown in FIGS. 1 and 2 and thus in FIGS. 3 and 4, there are given same reference symbols but with prefix "B" to indicate elements or members same with or corresponding to those in the preceding embodiments shown in FIGS. 1 and 2. Differences between the both embodiments lies merely in a configuration of corner flaps and a manner for assembling blank plate into final container. According to this second embodiment, each of the corner flaps B221A,B223A,B241A,B243A has a configuration of squere with a notch (FIG. 4) and the folded corner flap, for instance, the corner flap B241 contacts only with an inside surface of a flap of concerned side panel, for instance the flap B201 of the side panel B20. On an outer or reverse side of the flaps, for instance the flap B201, an adhesive is applied and a concerned side panel, for instance the side panel B14 is adhered thereon with the adhesive.

The tray type container shown in FIG. 3 shows advantages same with those in the first embodiment shown in FIG. 1.

To the tray type containers according to the invention and shown in FIGS. 1 and 3, a shrink or stretch synthetic resin film wrapping may be carried out to prevent from a shoplifting of commodities or protect the same from dust. In this case, so-called—full wrapping—is not always required. The film is applied to cover only an open area defined between the pair of the upper strips (22,24 in FIG. 1 and B22,B24 in FIG. 4) to save the film material and it may be easily fixed in position by an adhesive to increase wrapping workability.

I claim:

1. A tray type container which comprises a generally rectangular bottom panel, each of a first pair of opposite upright side panels foldably connected along one longitudinal side edge with said bottom panel, each of a second pair of opposite upright side panels foldably connected along one longitudinal side edge with said bottom panel, and a pair of upper horizontal strips, one of said strips being foldably connected along one longitudinal side edge with the longitudinal side edge of one of said second pair of upright side panels opposite said foldable connection of said one of said second pair of upright side panels to said bottom panel, the other of said strips being foldably connected along one longitudinal side edge with the longitudinal side edge of the other of said second pair of upright side panels opposite said foldable connection of said other of said second pair of upright side panels to said bottom panel, each one of said second pair of side panels and each one of said strips having at its opposite ends a foldable end flap, said foldable end flap at each end of said strips being foldably connected along a longitudinal edge to an edge of the end flap of the adjacent of said second pair of side panels, each said end flap at the end of each of said strips having a diagonal fold line extending outwardly from the foldable connection between the side panel and the strip, each said end flap at the end of each panel of said second pair of side panels being folded inwardly and foldably connected to the side of an upwardly folded panel of said second pair of side panels and is adhered to a side of one of said folded panels of said first pair of side panels, said flaps at the opposite ends of said strips being folded inwardly along the diagonal folds against the inside of the end flaps at the ends of the said second pair of side panels so that said flaps at the opposite ends of said strips are pushed and retained against an inner side of said end flaps of said second pair of side panels and forming a reinforcement in the corner of said tray type container.

2. A tray type container as claimed in claim 1, wherein the panels of said first pair of said side panels are shorter than the panels of said second pair of side panels and said strips foldably connected to said second pair of side panels, said strips folded on said upright second pair of side panels forming a container tray opening above said first pair of upright side panels.

* * * * *